United States Patent [19]

Deike

[11] 4,168,751

[45] Sep. 25, 1979

[54] DRIVER TOOL

[75] Inventor: Robert F. Deike, Cheyenne, Wyo.

[73] Assignee: Foresight Industries, Cheyenne, Wyo.

[21] Appl. No.: 727,402

[22] Filed: Sep. 29, 1976

Related U.S. Application Data

[63] Continuation-in-part of Ser. No. 575,462, May 7, 1975, Pat. No. 4,050,526.

[51] Int. Cl.[2] ..... B25D 9/00

[52] U.S. Cl. ..... 173/1; 173/133

[58] Field of Search ..... 173/1, 13, 14, 128, 173/131, 132, 133, 139, 162; 267/137; 279/1 A, 19, 19.1–19.7

[56] References Cited

U.S. PATENT DOCUMENTS

| | | | |
|---|---|---|---|
| 1,399,387 | 12/1921 | Jackson | 173/139 X |
| 1,954,411 | 4/1934 | Heitzman et al. | 173/14 |
| 2,413,542 | 12/1946 | Butts | 173/139 X |
| 2,500,402 | 3/1950 | Craig | 173/133 X |
| 2,519,477 | 8/1950 | Kind | 173/139 X |
| 2,917,953 | 12/1959 | Badali | 173/152 X |
| 3,054,464 | 9/1962 | Ondeck | 173/131 X |
| 3,191,694 | 6/1965 | Elliott et al. | 173/128 X |
| 3,244,241 | 4/1966 | Ferwerda | 173/105 |
| 3,332,503 | 7/1967 | Klebanov | 173/134 |
| 3,336,988 | 8/1967 | Jones | 173/133 |
| 3,746,104 | 7/1973 | McIntosh et al. | 173/43 |
| 3,991,835 | 11/1976 | Bailey et al. | 173/134 |
| 4,072,199 | 2/1978 | Wanner | 173/139 X |

FOREIGN PATENT DOCUMENTS

| | | | |
|---|---|---|---|
| 955217 | 12/1956 | Fed. Rep. of Germany | 173/133 |
| 560587 | 4/1975 | Switzerland | 173/139 |
| 278075 | 11/1970 | U.S.S.R. | 173/131 |

*Primary Examiner*—Lawrence J. Staab

*Attorney, Agent, or Firm*—Hill, Van Santen, Steadman, Chiara & Simpson

[57] ABSTRACT

A driver tool of the power hammer type is equipped with a compression spring acting on the anvil of the tool and loaded by the weight of the tool and by downcrowding to store energy from the load and from attempted rebound of the anvil which is released to the anvil in a driving direction adding to the driving force of the hammer. The spring has a stiffness and a length effective to maintain a free stroke length for the hammer before impacting the anvil when the tool is loaded or downcrowded sufficiently to maintain the anvil thrusting against the workpiece and to develop and build up vibrations from the hammer blows. The hammer blows are divided into impulses by the vibrations allowing the workpiece to recover from blows of magnitudes beyond the elastic limit of the workpiece material which would otherwise damage the workpiece. The preferred spring is a cylindrical spaced coil helical spring having its bottom coil engaging the anvil in good vibration transferring relation and a top end coil bottomed on the end wall of a slip housing surrounding the spring and anvil. The housing is bottomed on the bottom end face of the tool body. A nonmetallic slip washer is preferably interposed between the housing and the bottom end of the tool body to dampen transfer of vibrations into the tool body and to accommodate rotation of the anvil which is desirable when rock drill and the like breaker tools are mounted on the anvil.

23 Claims, 14 Drawing Figures

DRIVER TOOL

RELATED APPLICATION

This application is a continuation-in-part of my copending U.S. Pat. Application entitled "Post Driving Machine" Ser. No. 575,462 filed May 7, 1975.

FIELD OF THE INVENTION

This invention relates to the art of driver tool or power hammers useful for driving posts, drills, chisels and the like of the type having a rapidly oscillating hammer driven by pneumatic, hydraulic, electric or gasoline motors to deliver high velocity blows to an anvil. Specifically, the invention deals with increasing the efficiency of such driver tools and power hammers by creating and building up vibrations from the hammer blows on the anvil in a compression spring which stores energy from attempted recoil of the anvil continually thrusting it against the workpiece or breaker tool and releasing the energy in the direction of the hammer blow to add to the driving force of the blow.

PRIOR ART

Conventional power hammer rock drills, demolition tools and breaker tools operate with a rebound or pogo stick action allowing the rock drill, chisel or the like member driven by the tool to leave the work being acted on to produce a chopping or chipping action which was considered desirable. These power hammer tools transmitted their rebound or pogo stick action to the operator requiring considerable physical effort to hold the tool in position. This effort and vibration of the tool quickly fatigued the operator. In the Ferwerda U.S. Pat. No. 3,244,241, issued Apr. 5, 1966, a light recoil spring was provided on a power hammer to cushion the recoil of the anvil after the blow was delivered, but in common with the conventional power hammer tools, the chisel for the breaking tool was caused to leave the work for creating a chipping stroke and, in so operating, the undesired recoil or pogo stick action has to develop.

SUMMARY OF THIS INVENTION

According to this invention, the efficiency of power hammer tools is greatly increased by thrusting the anvil or anvil mounted drill or chisel of a power hammer tool constantly against the workpiece, by creating and building up vibrations from the hammer blows in a coil spring which absorbs and stores the rebound action of the anvil after the hammer has delivered its blow, and by delivering the stored energy in the spring and the built-up vibrations to add to the power impact force on the workpiece. The spring is compressed, by the weight of the tool and by downcrowding loads placed on the tool from the operator or from a boom on which the tool may be mounted, sufficiently to thrust the anvil or anvil mounted chisel or the like constantly against the workpiece but insufficient to interfere with the free stroke of the hammer so that it may continue to deliver effective blows to the anvil. The vibrations delivered to the anvil cause it to "dance" on the workpiece without losing its thrust load on the workpiece. Then when the hammer blow is delivered, the anvil advances and the spring lengthens to keep the anvil against the workpiece with any rebound force being fed back to the spring to add to the downcrowding force.

The spring has a stiffness and travel length selected to be compatible with the particular power hammer tool to support the downcrowding load and absorb the rebound or pogo stick action normally encountered in the operation of such hammer tools while developing vibrations adding to the driving force imparted to the anvil by the hammer. The selected compression spring picks up and enhances vibrations from the hammer blow on the anvil and feeds these back through the anvil dividing the hammer blows into increments or pulses and adding energy in the driving direction to the workpiece. A housing which slips over the anvil surrounds the spring which thrusts the housing against the bottom edge of the hammer tool body. The spring is compressed between the anvil and the bottom of the tool body and one or more vibrations absorbing slip washers are interposed between the housing and the tool body to further absorb vibrations back into the tool body and to accommodate rotation of the anvil relative to the tool body.

It is then an object of this invention to increase the efficiency of power hammers by creating vibrations and absorbing energy therefrom for delivery to the workpiece.

Another object of the invention is to convert recoil forces developed in power hammer tool into driving forces.

A further object of the invention is to spring load the anvils of power hammers against the workpiece while developing vibrations in the anvil which are transferred in a driving direction to the workpiece.

A specific object of this invention is to incorporate a compression spring between the bottom end of the tool body of a power hammer and the anvil of the hammer which is effective to stop recoil of the anvil off the workpiece and create vibrations in the anvil which will increment the hammer blows into a myriad of impulses allowing the workpiece to recover from impact fatigue which might otherwise damage the workpiece.

A specific object of this invention is to spring load the anvil of a power hammer tool against a workpiece and to impart vibrations to the anvil which will cause it to dance on the workpiece for breaking up the hammer blows into a myriad of impulses delivering the full impact blow to the workpiece without damage to the workpiece.

A further specific object of the invention is to surround the stem of the anvil of a power hammer with a spaced coil helical spring having its bottom coil tightly engaging a head on the anvil stem and its top coil thrusting against the bottom end face of the tool body and adapted to downcrowd the anvil against the workpiece while building up vibrations from the hammer blows on the anvil and storing energy from the recoil action of the anvil for delivery in a driving direction to the workpiece in a rapid pulse sequence.

Other and further objects of this invention will become apparent to those skilled in this art from the following detailed description of the annexed sheets of drawings, which by way of a preferred example illustrate one main embodiment of the invention with several anvil variations.

ON THE DRAWINGS

AS SHOWN ON THE DRAWINGS

Figure 1:
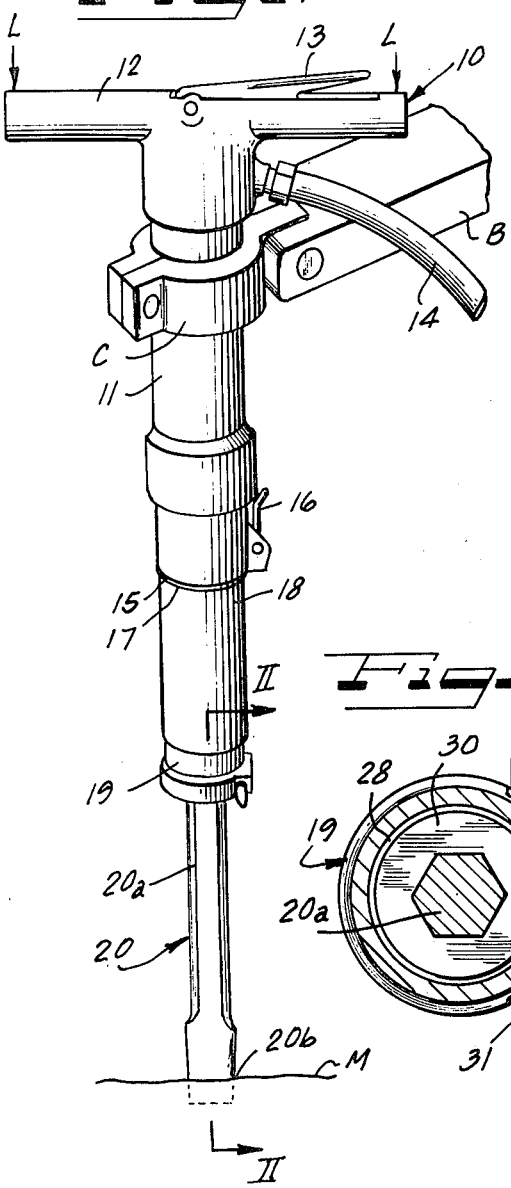
FIG. 1 is a side perspective view of a power hammer according to this invention.

In FIG. 1, the reference numeral 10 designates generally a power hammer having an upstanding cylindrical body 11, a transverse top handle 12 to be grasped by an operator, an actuating level 13 on the handle 12 for admitting power operating fluid from a supply hose 14 to drive a hammer which is slidably mounted in the body 11. The body 11 has a bottom end face 15. A latch 16 is pivotally mounted on the side of the body adjacent the bottom end face 15.

A shock-absorbing washer 17, preferably formed of a slippery plastics material such as a nylon bearing material, is mounted under the bottom end 15 of the body 11, and a cylindrical housing 18 abuts against this washer 17. An anvil head 19 projects from the open bottom end of the cylindrical housing 18 and mounts a chisel tool 20 having an elongated stem **20*a* and a chisel head 20*b* to be driven into rock, concrete, or the like material M acted on by the power hammer 10. The hammer is downcrowded through the chisel 20 against the material M by loads L applied to the handle 12 from the operator or from a power operated downcrowding boom B secured to the body 11** of the tool by a clamp C.

Figure 2:
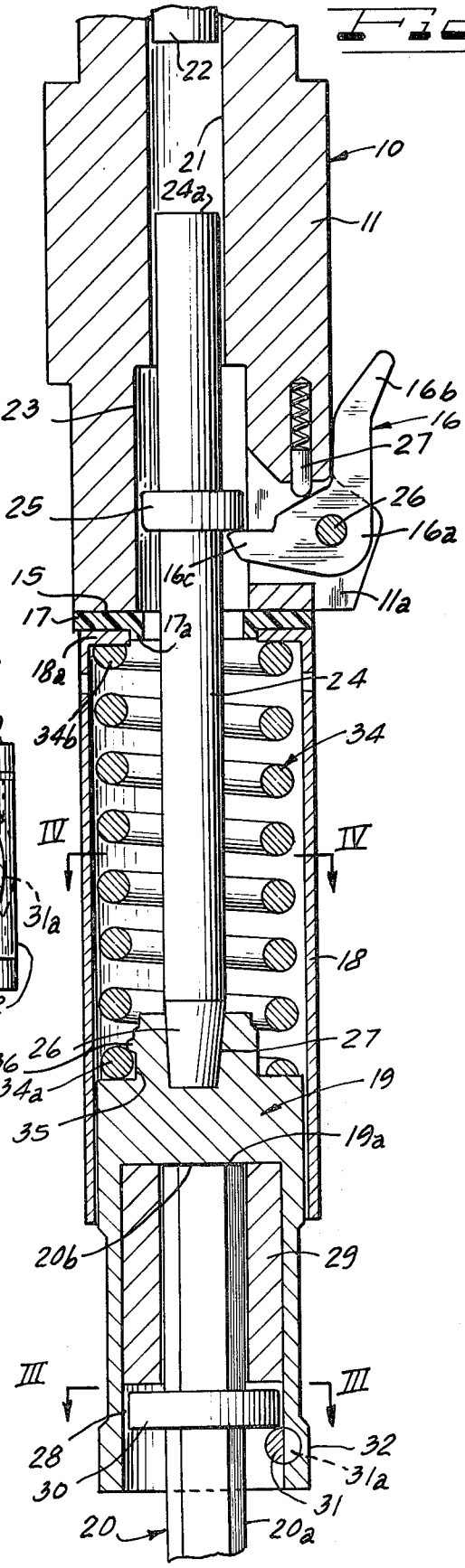
FIG. 2 is a fragmentary enlarged longitudinal cross sectional view of the power hammer of FIG. 1 taken generally along the line II—II of FIG. 1 and with the components in a relaxed extended position.

As shown in FIG. 2, the body 11 has a bore 21 slidably mounting a piston 22 which is rapidly reciprocated in a conventional manner from a power source such as compressed air, hydraulic fluid, an electric motor or a gasoline engine. The bore 21 communicates with an enlarged counter bore or chamber 23 in the lower end of the body and extending through the bottom end 15.

The anvil head 19 has a stem 24 extending through the housing 18 and chamber or bore 23 into the lower end of the bore 21. This stem 24 has a collar 25 thereabout intermediate the ends thereof which fits freely in the chamber 23. The latch 16 has a central body portion **16*a* fitting in a slot 11*a* in the body 11 at the bottom end 15 thereof and a pin 26 carried by the housing spans the slot to pivotally mount the latch. A first arm or finger 16*b* of the latch projects from the slot 11*a* upwardly alongside of the housing while a second finger or arm 16*c* extends through the slot to underlie the collar 25. A spring pressed detent 27 is slidably mounted in the housing 11 and acts on the body portion 16*a* of the latch to resist unauthorized tilting thereof. When the stem 24 is inserted in the chamber 23, the collar 25 will engage the underface of the finger 11*c* of the latch and as the collar is pushed upwardly, the latch will be tilted until the collar clears the finger whereupon the detent 27 will be effective to rotate the latch bringing the finger 16*b* against the housing 11 and positioning the finger 16*c* under the collar so that the stem will be retained in the housing 11. When it is desired to remove the stem and anvil, the finger 16*b* will be manually depressed to rotate the finger 16*c* out of contact with the collar 25**, whereupon the stem will drop out of the housing.

The anvil head 19 is fixed on the lower end of the stem 24 in any suitable manner such as by wedging a tapered end 26 of the stem into a tapered well 27 in the anvil head. The anvil head has a free sliding fit in the cylindrical housing 18 and has an open bottom cylindrical chamber 28 receiving the top end of the chisel shank or stem **20*a*. The recess 28 is substantially greater in diameter than the stem 20*a* and an adapter sleeve 29 fitting the recess is slipped over the top end of the stem 20*a* above an integral collar 30 on the stem. This sleeve 29 centers the stem in the recess 20*a* and is shorter in length than the distance between the collar 30 and the top end face 20*b* of the stem. This top end face 20*b* confronts a bottom face 19*a*** of the anvil head to impact thereagainst.

Figure 3:
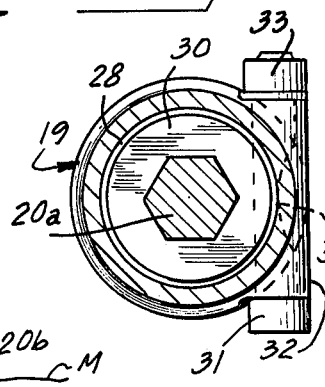
FIG. 3 is a transverse sectional view taken along the line III—III of FIG. 2.
Figure 4:
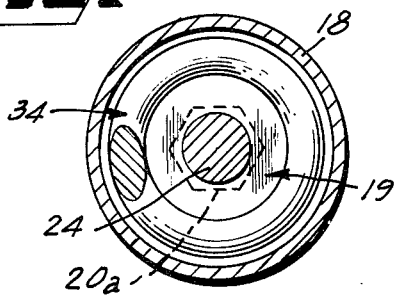
FIG. 4 is a transverse sectional view taken along the line IV—IV of FIG. 2.

The chisel stem is held in the recess **20*a* by a pin 31 rotatably mounted in a transverse boss 32 adjacent the bottom of the anvil 19 and as also shown in FIG. 3, the pin 31 has a central slot or recess 31*a* adapted to register with the chamber 28 to accommodate insertion of the collar 30 into the chamber above the pin. Then, when the pin is rotated to move the slot 31*a* out of registration with the chamber 28, the body of the pin will underlie the collar 30 and be effective to hold the chisel in the anvil. A nut 33** on the pin is effective to lock it against unauthorized rotation.

An open coil helical spring 34 is provided in the housing 18 with a bottom end coil **34*a* bottomed on the top of the anvil head 19 in snug engagement with a boss or nipple 35 in which the well 27 is formed. A rib 36 on this boss overlies the end coil 34*a*** to maintain firm contact of the end coil with the anvil head for transferring vibrations and for aligning the spring and anvil.

The top end coil **34*b* of the spring 34 is bottomed against a top wall 18*a* of the housing. This top wall 18*a* underlies the washer 17 and has a large diameter central aperture therethrough receiving a rim 17*a*** of the washer to center it on top of the housing.

In the position shown in FIG. 2, the spring 34 is in a relaxed expanded condition with the chisel 20 suspended freely from the anvil 19 with its collar 30 resting on the pin 31. In this relaxed condition of the spring 34, the collar 25 of the anvil stem 24 will rest on the latch finger 16*c* and the anvil head 19 will be suspended from this latch with the spring 34 holding the upper wall 18*a* of the housing loosely under the washer 17. The top end 24*a* of the anvil stem 24 is then spaced below the bottom of the stroke of the piston 22 so that, in the event the piston is activated, no impact blow will be received by the anvil.

Figures 5, 6, 7, 8:
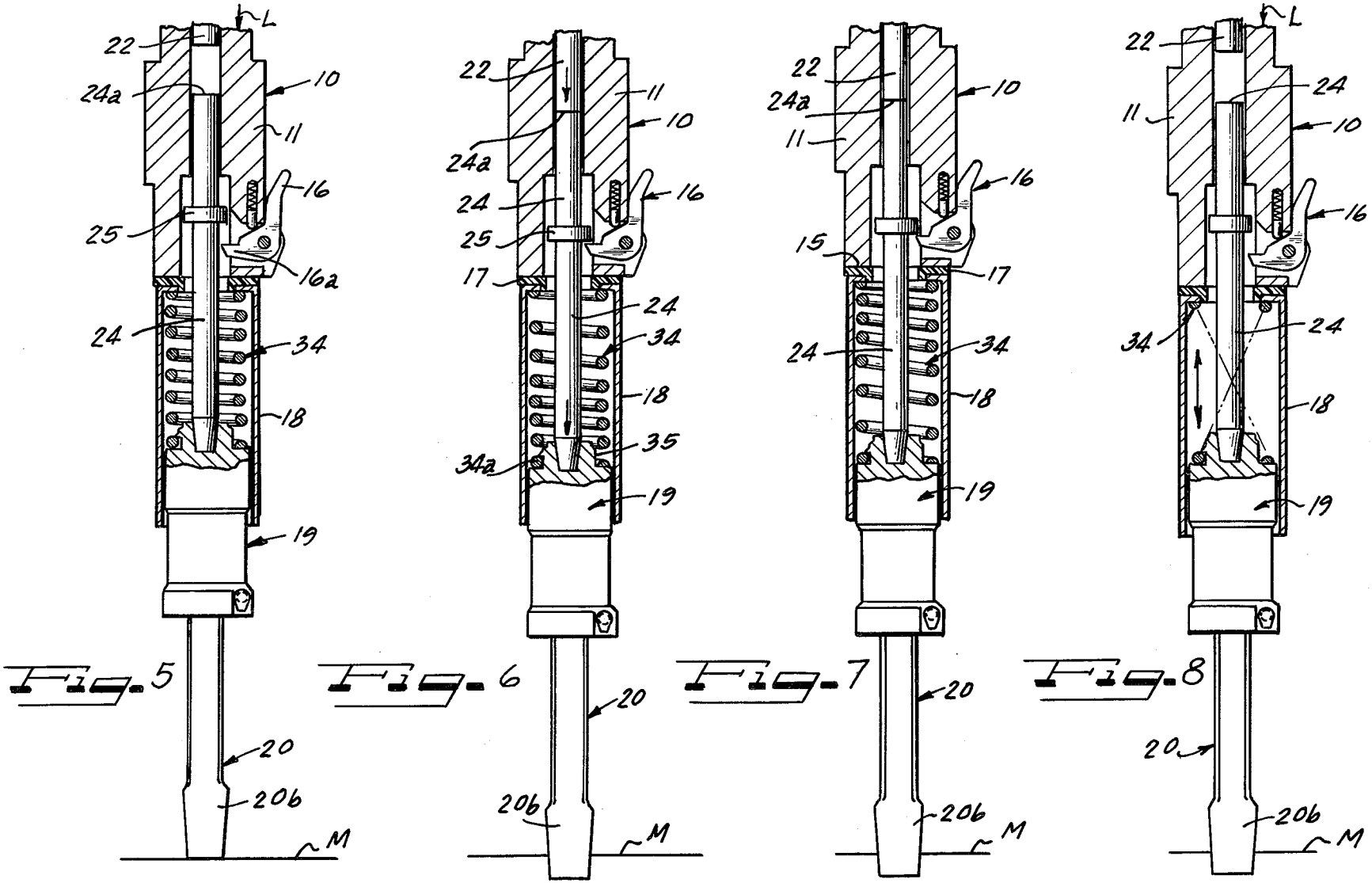
FIG. 5 is a view similar to FIG. 2 but showing the downcrowded positions of the components at the top of the stroke of the hammer.
FIG. 6 is a view similar to FIG. 5 but showing the positions of the components at the bottom of the stroke of the hammer.
FIG. 7 is a view similar to FIG. 6 but showing the positions of the components immediately after impact by the hammer to illustrate the build-up of the vibrations in the spring.
FIG. 8 is a view similar to FIG. 7 but showing the recovered position of the components after impact, with the tool body at a lower level resulting from the penetration of the chisel to the level of FIGS. 6 and 7.

However, when, as shown in FIG. 5, the weight of the tool 10 is supported by resting the chisel 20 on the material M to be broken up for impact, the spring 34 will be compressed by the weight of the tool body resting on the spring and will, of course, be further compressed upon application of a downcrowding load L on the tool body. In this attitude of the tool 10, the collar 25 of the anvil stem 24 will be raised above the latch finger 16*a* and the top end face 24*a* of the stem will be brought into the range of the stroke of the piston 22 to be impacted by the piston for the delivery of a hammer blow through the stem 24 to the anvil 19 and then, of course, through the chisel 20 to its cutting head 20*b*.

The initial downcrowding of the tool by its own weight and by the applied load L thus lowers the tool moving the housing 18 downwardly along the anvil head 19 and exerting an initial downcrowding load on the chisel.

Then, when the piston 22 impacts the top striking end 24*a* of the anvil stem 24 as shown in FIG. 6, the hammer blow on the anvil drives the head 20*b* of the chisel 20 into the material M and the spring 34 will expand to keep the level of the tool body 11 above the spring the same as before impact as shown in FIG. 5. The expanding spring 34 thus delivers its energy to the anvil and adds to the driving force of the tool.

The impact blow of the hammer 20 on the top end 24*a* of the anvil stem 24 creates vibrations which are built up along the length of the stem into the anvil head 19 and transmitted to the spring 34 through the bottom end coil 34*a* which, as explained above, is in good contact with the anvil head around the boss 35. The vibrations then travel through the spring coils 34 as illustrated from a comparison of FIGS. 6 and 7 where the bottom end coils of the spring are first closer together and then as the load is distributed along the length of the spring, the upper end coils are closer together. The vibrations are dampened against traveling into the tool body 11 by the washer 17 which, of course, is then pressed against the bottom end face 15 of the tool body.

The high velocity rapidly repeated hammer blows on the anvil stem create high frequency vibrations built up through the stem and spring and transferred to the anvil head 19 causing the impact surface 19*a* to dance on the top end face 20*b* of the chisel stem 20*a*. A vibration separation film is created between the surfaces 19*a* and 20*b*. Thus, the hammer blows are divided into impulses of very high frequency and even though the anvil transfers a hammer blow of sufficient magnitude to exceed the elastic limit of the workpiece which, in the illustrated case would be the top end 20*b* of the chisel stem, the workpiece remains undamaged because the blow is delivered in high frequency impulses allowing the stressed workpiece to recover between impulses. In addition, the high frequency impulses are transferred to the workpiece causing it to vibrate with the vibration adding to the driving force of the downcrowding spring and the impact blow of the hammer thereby increasing the driving capacity of the tool without damaging the work. The energy stored in the compressed spring both from a downcrowding load thereon and the vibrations imparted thereto is thus released in a driving direction with the impact blows from the hammer.

As shown in FIG. 8, after the hammer blow and the retraction of the hammer 22 away from the top end 24*a* of the anvil stem 24, there would normally be a recoil action causing the tool body 11 to bounce like a pogo stick. However, in accordance with this invention, the spring 34 keeps the anvil 19 in thrusting engagement with the chisel and the continued weight of the tool body 11 and the downcrowding load L causes the tool body to descend to the new level of the chisel which has pierced the material M and in so doing, the spring 34 is compressed back to the condition of FIG. 5 with its stored energy ready to be delivered to the work on the next hammer blow.

It should be appreciated that all of the operating steps of FIGS. 5–8 occur on each stroke of the piston 22 and since power hammer tools generally operate in the range of 900 to 3,000 piston strokes per minute, the operating sequence occurs at very high frequency developing sonic and even ultrasonic vibrations.

The stiffness or rate of the spring 34 is selected so that the applied downcrowding loads will not collapse the spaced coils into contact nor will the vibrations or loads overheat the spring. The resistance or classification of the material to receive the workpiece is a factor in selecting spring rate or stiffness. If the tool is to be used for driving a workpiece into hard material such as concrete or rock, the spring should be stiffer than when the tool is to be used on soil or sand. In general, a rock tool will use a spring 30 to 50% stiffer than a sand or soil tool. Thus, for a 60-pound hammer (60-foot-pounds per blow) a 90-pound spring is useful in sand or soil while a 120-pound or stiffer spring is useful in rock.

The compressed or downcrowded length of the open coil spring should not permit the anvil stem to move into the bore 21 sufficiently to receive the hammer blow before the hammer has a sufficient free downstroke to develop acceleration for an effective impact blow. In general, the blow should not be delivered to the anvil stem in the upper half of the down stroke of the piston. Thus, the lighter or less stiff springs for soil or sand use may be longer than the stiffer springs for rock use to prevent the anvil stem from riding into the upper half of the piston downstroke.

Figure 9:
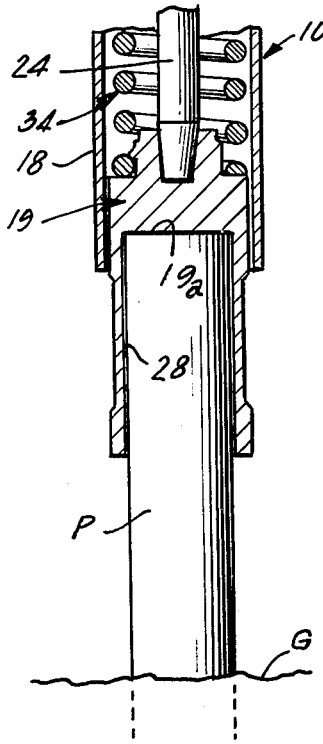
FIG. 9 is a fragmentary longitudinal section of the lower end of the power hammer with the anvil receiving a post being driven into the ground.

As shown in FIG. 9, in place of driving the chisel 20 shown in FIGS. 2–8, the anvil head 19 may directly act on a workpiece such as post P being driven into the ground G. The upper end of the post P fits freely in the chamber 28 of the anvil head 19 with the top end of the post impacted by the surface 19*a* of the anvil head and dancing on the post from the high frequency vibrations imparted to the anvil head so as to prevent peoning or damage of the post.

Figure 10:
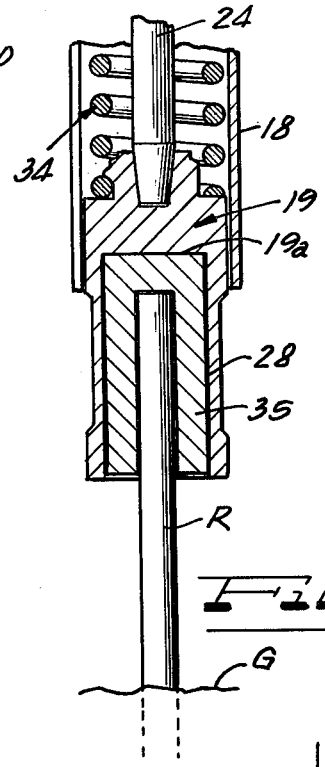
FIG. 10 is a view similar to FIG. 9, but showing an adapter in the anvil to accommodate a small diameter rod being driven in the ground.

As shown in FIG. 10, the workpiece is in the form of a rod R being driven in the ground G. To adapt the rod to the chamber 28 of the anvil head 19, a cap 35 is fitted over the top end of the rod and snugly fits in the chamber 28 to be impacted by surface 19*a* of the anvil 19 and operate in the same manner as described above.

Figure 11:
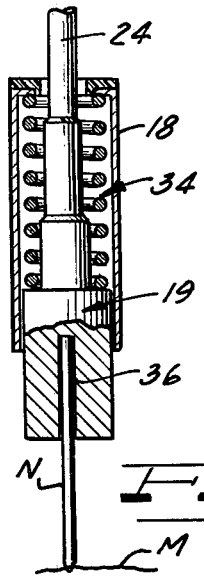
FIG. 11 is a view similar to FIG. 10 showing the lower end of the tool according to this invention adapted for driving nails.

As shown in FIG. 11, the anvil head 19 takes the form of a solid cylinder loosely fitting in the housing 18 but having a small diameter well 36 for receiving a workpiece in the form of a metal nail N to be driven into material M such as a pavement, a wall or the like.

From the showings in FIGS. 9–11, it will be understood that adapters and anvil shapes and sizes are widely variable for different working conditions.

Figure 12:
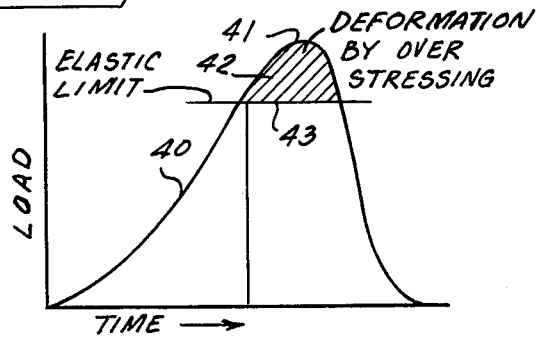
Fig. 12 (PRIOR ART)
FIG. 12 is an illustrative graph showing how tools of the prior art are limited to delivery of impact blows below the fatigue strength of the workpiece without damaging the workpiece.
Figure 13:
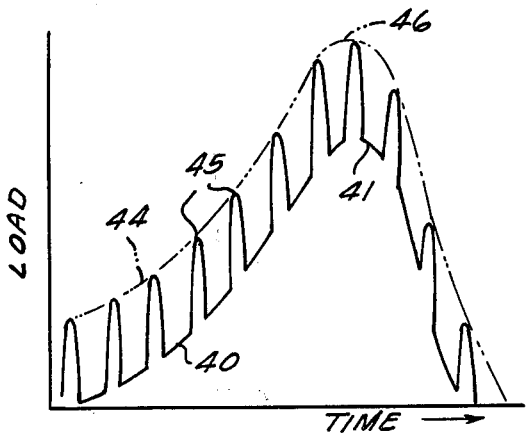
FIG. 13 is an illustrative graph showing how the tools of this invention can deliver impact blows exceeding the fatigue strength of the workpiece without damaging the workpiece and how these blows are pulsed or incremented to increase the driving energy.
Figure 14:
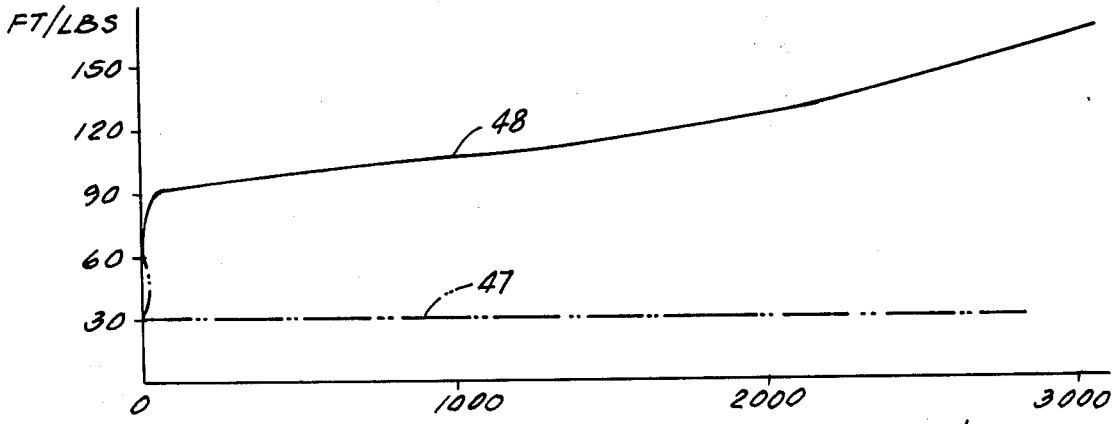
FIG. 14 is an illustrative graph comparing the power output of a conventional 60-pound power hammer and the same power hammer equipped with this invention.

FIGS. 12–14 attempt to illustrate graphically the operation of the power hammers of this invention, but it should be understood that they are not intended to reflect actual operating data and are illustrative only.

In FIG. 12, the effect of the conventional power hammer impact on a workpiece is illustrated by the curve 40 plotted in terms of time in which it acts on the workpiece and foot-pound impact load which it delivers. A single stroke of the power hammer is illustrated. The curve 40 raises rapidly from zero to a peak 41 and then drops abruptly back to zero after delivery of the impact blow. Now, if the impact blow is heavy enough to exceed the elastic limit of the workpiece, deformation of the workpiece will occur during that portion of the blow illustrated by the shaded area 42 and because of the elapsed time interval in which this overstressing of the workpiece occurs above the elastic limit, permanent deformation and damage to the workpiece will take place in the form of peening, feathering and even splintering of the workpiece. Thus, the blow must not exceed the plateau 43.

However, as shown in FIG. 13, the same stroke of a power hammer of this invention is plotted in the same time interval as in FIG. 12, but because of the energy stored by the spring 34 and the vibrations imparted to the anvil, causing it to dance on the workpiece, the load delivered is increased from curve 40 to curve 44 and is delivered in the form of impulses 45 which rapidly rise and fall so that the stressed workpiece even at stresses above its elastic limit, will recover without deformation. Thus a peak 46 substantially above the peak 41 is achieved without damage to the workpiece and with the same power input to the hammer.

In FIG. 14, the output of a conventional 60-foot-pound per blow jack hammer is plotted against the output of the same jack hammer equipped with the vibration and downcrowding spring assembly of this invention. As shown, the strokes per minute of a 60-pound hammer are plotted as abscissa and the foot-pound deliveries for each blow of the hammer are plotted as ordinates. As shown by the line 47, the conventional 60-pound jack hammer because of its pogo stick rebound action, only has a power delivery of about 40-foot pounds per blow regardless of the increase in the strokes per minute of the hammer. By comparison, the curve 48 shows that the same hammer will have a power delivery of about 90-foot pounds per blow and that this delivery increases as the rate of hammer strokes increase. The increased power delivery is brought about by the downcrowding load and by the absorption of rebound action which compress the spring to store energy that is delivered with the hammer blow and by the development of higher frequency vibrations which pulse or increment each blow to render it more effective for driving.

From the above descriptions, it should therefore be understood that this invention provides power hammers of enhanced driving capacity without requiring added power input.

I claim as my invention:

1. A power hammer tool of the type having a piston driven to reciprocate at high speeds, an anvil suspended from the tool impacted by said piston to deliver driving forces to a workpiece, means accommodating axial movement between the anvil and workpiece, a spaced coil spring mounted on the tool, means for holding said coil spring in firm engagement with the anvil to receive vibrations from the anvil and to be compressed against the anvil without collapsing the coils into contact with each other when the tool is downcrowded against the workpiece to deliver driving forces, said spring storing down-crowding and rebound forces from the tool and building up vibrations from the piston blows on the anvil and delivering the stored forces and vibrations through the anvil to the workpiece, and said means accommodating axial movement between the anvil and workpiece permitting the anvil to deliver the stored forces in impulses to the workpiece and form a vibration separation film therebetween.

2. In a power hammer tool of the type having a body, a piston slidable in the body, means for driving the piston to reciprocate rapidly in the body and an anvil carried by the body impacted by the piston to drive a tool or workpiece, the improvement of a coil spring mounted on the tool, means for holding said coil spring in firm engagement with the anvil to act between the anvil and the body and adapted to be compressed by the combined weight of the tool and by downcrowding loads applied to the tool for holding the anvil against a workpiece, said spring being additionally momentarily compressed by attempted anvil rebound after each piston blow on the anvil for absorbing rebound energy from the anvil and effective to build up vibration from the piston blows on the anvil for storing energy, and means accommodating axial movement between the anvil and workpiece delivering said energy to the workpiece in impulses on each piston blow.

3. A power hammer tool comprising a body having a piston bore, a piston slidable in said bore, means for driving said piston to reciprocate at high speeds in said bore, an anvil having a stem extending into said bore to be impacted by said piston and a head on said stem spaced from the bottom end of the body, a compression coil spring surrounding said stem in thrusting relation between the bottom end of the body and said anvil head, means for holding said coil spring in firm engagement with the anvil head, means for downcrowding said body to compress said spring against said anvil head, said anvil head having an open bottom chamber adapted to slidably receive a workpiece to be impacted by the anvil head, said spring when compressed by said downcrowding of said body holding the anvil against the workpiece, and said compressed spring absorbing rebound energy from the anvil and building up vibrations when the anvil is impacted by the piston causing the anvil to deliver added driving force in impulses to the workpiece.

4. A power hammer tool comprising a body having a longitudinal bore therein and an enlarged counterbore opening through the bottom end of the body, a piston slidable in said bore, means for driving said piston to reciprocate in the bore at about 900 to about 3000 strokes per minute, an anvil detachable from said body having a stem extending through said counterbore into said bore and projecting beyond the bottom of said body carrying an enlarged anvil head on the projected end thereof, a collar on said stem in said counterbore, a latch adapted to releasably engage the underface of said collar for retaining the upper end of the stem in said bore, a cylindrical open bottom housing receiving the anvil head therein and the anvil stem therethrough having an apertured top wall, a coil spring in said housing surrounding said anvil stem and compressed between the apertured top wall of the housing and the anvil head, said housing adapted to rotate relative to said body, and said anvil having an open bottom chamber, a workpiece axially shiftable in said chamber and arranged to be struck by said anvil whereby the reciprocating piston will impact the top of the anvil stem to deliver driving blows to the anvil head for transfer to the workpiece and said spring will compress under the weight of the tool body and downcrowding loads applied to the tool body for holding the anvil against the workpiece, for absorbing rebound energy from the anvil and for building up vibration from the piston blows on the anvil stem to deliver added driving force in impulses to the workpiece with the piston blows.

5. The power hammer tool of claim 1 wherein the piston is driven to reciprocate at about 900 to about 3000 strokes per minute.

6. The power hammer tool of claim 1 wherein the tool has an elongated body with a longitudinal bore opening through the bottom of the body and slidably supporting the piston, the anvil has a stem extending through the open bottom of the body into the bore to be impacted by the piston, and the coil spring surrounds the stem and is compressed against the bottom of the body.

7. The power hammer tool of claim 1 wherein the tool has a main elongated body with a bore slidably mounting the piston and an open bottom end, and the anvil is removably suspended from the bottom end of the body with the coil spring compressed between the anvil and the bottom end of the body.

8. The power hammer tool of claim 1 wherein the coil spring has a stiffness supporting loads 30 to 50 percent greater than the impact load delivered by the piston to the anvil.

9. The power hammer tool of claim 1 including power means for down-crowding the tool.

10. The tool of claim 2 including a vibration absorbing washer between the body and the spring accommodating rotation of the anvil and spring relative to the housing.

11. The tool of claim 2 wherein the hammer reciprocates at speeds of 900 to 3000 strokes per minute and the vibrations developed in the anvil by the spring are in the sonic and ultrasonic range.

12. The tool of claim 2 including a housing bottomed on the bottom of the tool body receiving the spring and guiding the anvil.

13. The tool of claim 2 wherein the means holding the coil spring in firm engagement with the anvil is a boss receiving the bottom end coil of the spring therearound and a rib on the boss overlying the bottom end coil.

14. The tool of claim 3 wherein the spring absorbs rebound energy of the anvil after impact blows by the piston and stores the rebound energy for delivery to the anvil with the next piston blow on the anvil.

15. The tool of claim 3 wherein the spring is easily replaceable to satisfy working conditions for the tool.

16. The tool of claim 3 wherein a latch on the tool body releasably retains the stem in the bore.

17. The tool of claim 3 including means firmly seating the spring on the anvil head.

18. The tool of claim 4 wherein the spring is sufficiently stiff to maintain the coils in spaced relation on application of maximum downcrowding loads.

19. The tool of claim 4 wherein the spring builds up vibrations at least into the sonic range.

20. The method of increasing the driving force of power hammers of the type having tool bodies with power driven rapidly reciprocating pistons impacting anvils to drive workpieces which are axially shiftable relative to the anvil which comprises, incorporating a compression spring between the tool body and anvil in firm engagement with the anvil, downcrowding the body to compress the spring to hold the anvil against the workpiece, and selecting the stiffness and length of the spring to prevent collapse of the spring under the downcrowding load, to elongate from its downcrowded loaded position to a length sufficient to maintain the anvil thrusting against the workpiece, to shorten from said elongated length for absorbing rebound energy of the anvil after impact by the piston while continuing to hold the anvil thrusting against the workpiece, and to build up vibrations from the piston blows on the anvil for causing the anvil to deliver added driving force in impulses to the workpiece.

21. The method of increasing the driving force of a power hammer tool with a high speed piston impacting an anvil without requiring increased power input which comprises, spring loading the anvil of the tool against a workpiece movable axially relative to the anvil through a spaced coil compression spring, maintaining the spring in firm engagement with the anvil, selecting the stiffness of the spring to maintain the coils in spaced relation under said load, selecting the length of the spring to elongate from its loaded compressed position sufficiently to follow the anvil after impact and hold the anvil against the workpiece, compressing the spring from its elongated condition after impact of the anvil by the piston for absorbing rebound energy from the anvil without rebounding the tool, continuing the load on the anvil to advance the tool, building up vibrations through the spring from the impact blows on the anvil to vibrate the anvil on the workpiece at a high frequency, and delivering energy stored in the spring from the load, from the rebound and from the vibrations in impulses to drive the workpiece.

22. An attachment for a power hammer having a body with an open bottom portion, a piston slidable in the body, a driver in the body reciprocating the piston at high speeds and a retaining device at the bottom of the body, said attachment comprising a stem adapted to project into the open bottom of the housing to be impacted by said piston, means on said stem engageable with said retaining device to suspend the stem from the body, an anvil head on said stem, an open coil spring surrounding said stem and thrusting at opposite ends against the body and against the anvil, and means adapted to suspend a tool from said anvil in axially shiftable relation, said tool body adapted to be downcrowded to compress said spring for holding the anvil against the workpiece, and said spring being effective to build up vibrations in the anvil when the anvil head is struck by said piston to cause the anvil to dance on the workpiece.

23. An attachment for a power hammer having a body with an open bottom end, a piston slidable in the body, a drive in the body reciprocating the piston at high speeds, and a latch at the bottom of the body, said attachment comprising an open-ended housing, an anvil head projecting into the open bottom of the housing, a stem secured to the top of the anvil head projecting through the housing and extending above the open top of the housing to project into the open bottom of the tool body for receiving impact blows from the piston, means on said stem to engage said latch to suspend the anvil from the body, a coil spring surrounding the stem in the housing compressed between the anvil head and the top of the housing and effective to seat the top of the housing against the bottom of the body, said anvil head having an open bottom tool recess, means freely suspending a tool in said recess to be impacted by said anvil, and said spring being effective to vibrate said anvil head when said stem is impacted by said piston to cause said anvil head to dance on said tool and break up the impact blows of said hammer into high frequency impulses.

* * * * *